United States Patent [19]

Tochilkin et al.

[11] 4,023,225

[45] May 17, 1977

[54] METHOD OF FABRICATION OF HEADED-SHANK PARTS FROM HIGH-STRENGTH TWO-PHASE TITANIUM ALLOYS

[76] Inventors: Anatoly Andreevich Tochilkin, Okruzhnoi proezd, 24, kv. 14; Vladilen Filippovich Pshirkov, ulitsa Svobody, 28, korpus 2, kv. 61; Semen Abramovich Vigdorchik, ulitsa K.Marxa, 20, kv. 291, all of Moscow; Igor Andreevich Vorobiev, ulitsa Kavalikhinskaya, 77, kv. 59; Viktor Grigorievich Petrikov, ulitsa Dzerzhinskogo, 24 "g", kv. 12, both of Gorky Nizhegorodsky raion; Alexandr Andreevich Kastosov, ulitsa Pravdy, 5a, kv. 3, Gorky, Leninsky raion, all of U.S.S.R.

[22] Filed: Oct. 24, 1975

[21] Appl. No.: 625,840

[30] Foreign Application Priority Data

Nov. 1, 1974 U.S.S.R. ..... 2072060

[52] U.S. Cl. ..... 10/27 R

[51] Int. Cl.[2] ..... B21K 1/46; B21K 1/58

[58] Field of Search ..... 10/10 R, 27 R, 27 E, 10/27 H; 85/1 R, 37; 148/11.5 F

[56] References Cited

UNITED STATES PATENTS

| | | | |
|---|---|---|---|
| 2,637,672 | 5/1953 | Losco et al. | 10/27 R |
| 2,799,027 | 7/1957 | Hatebur | 10/27 R |
| 3,298,725 | 1/1967 | Boteler | 85/1 R |
| 3,635,068 | 1/1972 | Watmough et al. | 148/11.5 F |
| 3,867,208 | 2/1975 | Grekov et al. | 148/11.5 F |

FOREIGN PATENTS OR APPLICATIONS

| | | | |
|---|---|---|---|
| 1,234,111 | 6/1971 | United Kingdom | 72/42 |

OTHER PUBLICATIONS

Fastener Technical Section, pp. 8, 9.

*Primary Examiner*—E. M. Combs
*Attorney, Agent, or Firm*—Lackenbach, Lilling & Siegel

[57] ABSTRACT

A method of fabricating headed-shank parts from high-strength two-phase titanium alloys characterized by using an oxalate coating capable of forming a fine-crystalline salt film, cold shaping the shank by reduction, and simultaneous heading and rolling the shank and the radius under the head. The shank is reduced and headed at a speed of 0.5 – 1.0 m/s. The use of the oxalate coating and of the cold-shaping speeds within the above-mentioned limits has made it possible to use automatic cold-heading machines thus raising the productivity of the process 20 – 30 times and producing parts of a higher quality. The method can be widely used for making such parts as rivets, bolts, screws, rivet-bolts and core rivets.

7 Claims, 9 Drawing Figures

METHOD OF FABRICATION OF HEADED-SHANK PARTS FROM HIGH-STRENGTH TWO-PHASE TITANIUM ALLOYS

The present invention relates to the field of pressure metalworking, and more particularly it relates to a method fabricating headed-shank parts from high-strength two-phase titanium alloys.

The invention can be effectively used for fabricating rivets, bolts, screws, bolt-rivets, core rivets or rivets of the "Jaw-bolt" type, which are used extensively at present in aircraft engineering for the purpose of reducing the weight of aircraft, and also in some branches of chemical and general machine building.

Today, the headed-shank parts are made from high-strength two-phase titanium alloys as follows: a bar billet with a protective coating is hot headed after which the head is turned to the required height on a lathe, the shank is ground, the parts are hardened in a vacuum or in an argon atmosphere and then, aged, and, finally, a radius is rolled under the head.

When necessary, the threaded portion of the shank is machined to size and the thread is rolled on it.

The protective coating used during hot heading is constituted of a liquid lubricant.

However, this known method of fabricating of headed-shank parts from high-strength two-phase titanium alloys suffers from a number of substantial disadvantages. In the first place, the method involves a large amount of labour for fabricating the parts in view of the many finishing mechanical operations, a low productivity of the hot-heading process, a great wastage of material in the form of chips during machining of the shank, and instability of preset mechanical properties due to the complexity of heat treatment. This complexity is caused mainly by the high sensitivity of the high-strength two-phase titanium alloys to the temperature of heating and its variations. In addition, each melt of the alloy requires different conditions of hardening, or ageing due to the variations in the phase and chemical compositions of the alloy. The operations of hot heading and heat hardening call for the use of special equipment. Another factor worthy of note is the low stability of the tools employed for machining.

Another known method of fabricating headed-shank parts is cold plastic shaping comprising the steps of cold pressing the head, extruding the shank and reducing its threaded portion. This method is intended for the fabrication of headed-shank parts from carbon, alloys and stainless steels.

Fabrication of a headed-shank from high-strength and low-plastic alloy steels by the method of cold plastic shaping involving the reduction of the shank cannot guarantee the absence of cracks in the fabricated parts.

To eliminate the aforesaid disadvantages, improve the quality of parts and obtain the required strength and plasticity characteristics in fabricating the headed-Shank parts, some authors recommend the use of cold plastic shaping with multiple reduction of the shank.

For example, widely known in industrial practice and technical literature is a method of fabricating headed-shank parts by cold heading with multiple reduction; this method comprises upsetting of the sheared-off billet in a closed die for truing its ends and forming the entry face of the shank, first reduction of the shank, second reduction of the shank and preliminary upsetting of the inverted-cone head, final forming of the head and final reduction of the shank.

Multiple reduction of the shank makes it possible to set up a highly-productive automated fabrication of shank parts with high strength characteristics without intermediate annealing.

However, the above method is suitable for making parts from carbon and alloy steels but cannot be employed for making headed-shank parts from high-strength low-plastic two-phase titanium alloys. These materials do not have sufficient plasticity and are sensitive to loading; the forming speed being the same, intermittent upsetting of the shank results in a more rapid failure than occurs during continuous upsetting of the same shank; and in the course of billet forming the material sticks to the tool.

In addition, the known equipment for cold plastic forming of headed-shank parts has a wide range of forming speeds from 0.1 to 20 m/s and higher. It is known that in most cases forming alloys at high speeds sharply reduces their plasticity and leads to premature failure of parts. This refers to aluminium, alloyed and stainless metals. For example, plasticity of a number of austenitic stainless steels drops by 40% when the shaping speed increases from 2 mm/min to 20 m/s. It is known that changes in the plasticity of alloys at high forming speeds does not depend on the type of crystal lattice and initial plasticity of the material. Therefore, correct selection of the forming speed is an indispensable prerequisite for fabricating high-quality products.

Known in the art is the use of various protective coatings on the billets in the course of cold plastic shaping, e.g. oxalate coating is used with certain kinds of stainless steels.

It is known that a properly selected scheme of loading the billet during the fabrication of headed-shank parts and a minimum nonuniformity of deformation during cold plastic shaping, depending mainly on the conditions of friction between the tool and the face of the head being upset, are the factors on which the absence of defects in the fabricated articles greatly depends. Failure to observe the optimum conditions of friction results in a nonuniform deformation of metal within the billet and often causes the head to break off the shank. Up to the present, there has been no research into the problem of how the ultimate plasticity of materials is affected by such factors as the geometrical dimensions of the billet, the conditions of friction on the surface of the head being upset, the scheme of stressed state, the nonuniformity of deformation and the forming speed. This complicates the correct organization of the process of cold plastic forming of headed-shank parts.

One of the main objects of the present invention lies in providing a method of fabricating headed-shank parts from high-strength two-phase titanium alloys which would be suitable for making parts with high strength and fatigue characteristics by cold shaping.

Another object of the present invention is to step up the productivity of the process.

Still another object of the invention is to reduce wastage of materials in the form of chips.

And a further object is to reduce the amount of labour involved.

These and other objects are achieved by providing a method of fabricating of headed-shank parts from high-strength two-phase titanium alloys in which a bar billet with a protective coating is shaped into a head and a shank, and a radius is rolled under the head. In this method, according to the invention, the billet is protected by an oxalate coating capable of forming a fine-crystalline salt film, the shank is shaped in a cold state by reduction, and is then upset to form a head, the operations of reducing the shank and upsetting the head being performed at a speed of 0.5 – 1.0 m/s and being followed by simultaneous rolling of the shank and of the radius under the head.

Owing to the use of said oxalate coating and of the cold shaping speeds mentioned above, it has become possible to fabricate headed-shank parts from high-strength two-phase titanium alloys on automatic cold-heading machines. This raised the productivity of the process 20 – 30 times, reduced the amount of labour required 2 – 3 times, increased the material utilization factor, and permitted the fabrication of parts with a highly accurate geometrical dimensions and with a high stability of their mechanical characteristics.

The problem of fabricating threaded shank parts is solved by rolling the thread on the shanks from high-strength two-phase titanium alloys at a speed of 16 – 20 rpm within 0.5 – 1 s. It ensures the rolling of a thread with a high accuracy of its parameters, a high quality of the surface layer and good fatigue characteristics.

Another characteristic of the invention consists in that the diameter of the billet is actually equal to 1.05 – 1.18 of the shank diameter.

In the course of deformation-hardening of the high-strength two-phase titanium alloy the invention has made it possible to obtain high strength characteristics, viz., tensile strength $\delta_b \geqslant 100$ kgf/mm², shearing strength $\tau_{cp} \geqslant 63$ kgf/mm², elongation $\delta \geqslant 16\%$, to ensure favourable distribution of stresses in the head of the part, thus ensuring a maximum dynamic strength of the shank head.

It is practicable that the allowance for shank rolling should range from 0.01 to 0.04 mm. This ensures a favourable distribution of compressive stresses in the shank part, its surface finish reaching 10 class, and the geometrical dimensions being within 1 – 2 classes of accuracy.

Now the invention will be described in detail by way of example with reference to the accompanying drawings in which.

Now, the method of fabricating a rivet is given as an example of realization of the present invention.

Shown in FIGS. 1, 2, 3, 4 is the sequence of technological operations for making a countersunk head rivet by the cold plastic shaping method from a high-strength two-phase titanium alloy in the form of a ground bar or wire. The bar is covered with an oxalate coating, which is applied by a known method, which forms a fine-crystalline salt film on the billet.

Figure 1:
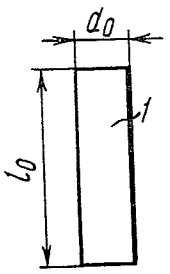
FIG. 1 is a schematic view of a billet for a countersunk head rivet after shearing.
Figure 4:
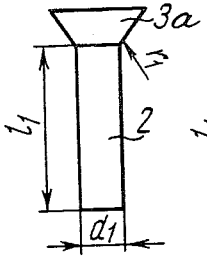
FIG. 4 shows the billet after final heading.

A billet with a length of $l_0$ is sheared from a bar with a diameter of $d_0$ (FIG. 1). Then the billet 1 is reduced in a cold state to form a shank 2 (FIG. 2) with a diameter of $d_1$ throughout its length $l_1$. The diameter $d_0$ of the billet 1 is equal to 1.05 – 1.18 of $d_1$, i.e. of the shank diameter after reduction. Then the remaining part of the billet is upset to form a barrel-shaped head 3 (FIG. 3) with a diameter of $d_2$. Next, the head is finally shaped to the prescribed configuration 3*a* (FIG. 4).

The process of cold plastic shaping during reduction and heading is conducted at a speed of 0.5 – 1.0 m/s. A speed above 1.0 m/s will reduce the maximum plasticity of high-strength two-phase titanium alloys and cause their ultimate failure during plastic shaping. The speeds below 0.5 m/s will reduce the productivity of the plastic shaping process.

Then the billet (FIG. 4) is finished in a barrel by a known method, washed in hot water (at 60°– 90° C) and dried.

Figure 5:
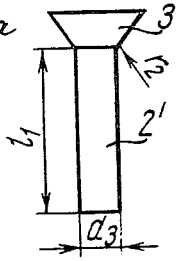
FIG. 5 shows a finished countersunk head rivet after rolling the rivet shank and the radius under the head.

The rivet shank 2′ (FIG. 5) of the preset diameter is produced by simultaneously rolling said shank 2 from diameter $d_1$ to $d_3$ and rolling the radius under the head of the shank 2 from size $r_1$ to $r_2$. The diameter allowance for rolling the shank 2 varies from 0.01 to 0.04 mm. A larger allowance results in a peeling of the surface layer of the shank 2′ while a smaller allowance fails to ensure the required surface finish, accuracy of geometrical dimensions and sufficient compressive stresses. Rolling is performed by rollers whose radius is 0.1 – 0.2 mm smaller than the radius of the cross section of the shank 2 before rolling. Failure to observe these rules will distort the geometrical dimensions of the shank and cause splashing of the metal.

The finished rivets are subjected to a fluorescent penetrant inspection and a strength test.

After this type of rolling the finished rivets display the following mechanical properties: tensile strength $\delta_f \geqslant 100$ kgf/mm²; elongation $\delta > 16\%$; and shearing strength $\tau \geqslant 63$ kgf/mm².

Figure 2:
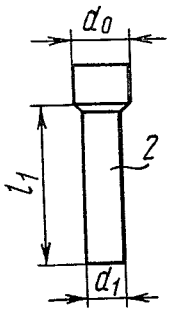
FIG. 2 shows the billet after reduction.
Figure 3:
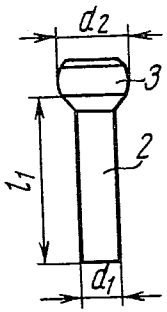
FIG. 3 shows the billet after preliminary heading.

The fabrication of threaded-shank parts, e.g. bolts, is illustrated below by an example of fabricating a hexagon-headed bolt by the method of cold plastic shaping from high-strength two-phase titanium alloys. The billet with an oxalate coating and the shank after reduction shown in FIGS. 1, 2 are practically the same as described above for the rivets.

Figure 6:
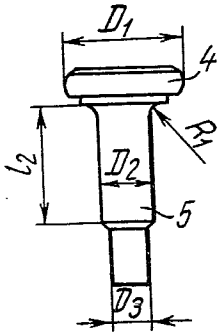
FIG. 6 shows the bolt billet after heading and reducing the shank for threaded rolling.

Then the bolt head 4 (FIG. 6) is upset to the required diameter $D_1$ and the shank 5 is reduced for threading in a cold state from diameter $D_2$ to $D_3$.

Figure 7:
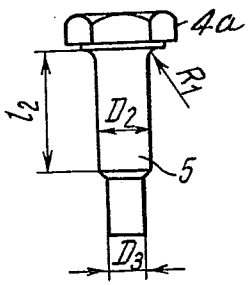
FIG. 7 shows the billet after cutting the hexagon.

Now the head 4 (FIG. 7) is trimmed by a known method to form the hexagon 4*a*. Then the parts are barrel-finished, washed and dried as described in the preceding example.

Figure 8:
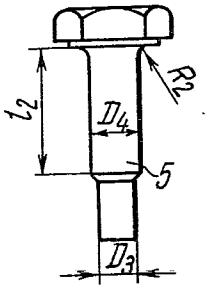
FIG. 8 shows the billet after rolling the shank and the radius under the head.

To obtain the required size and surface finish, the shank 5 with diameter $D_2$ on the length $l_2$ is rolled to a diameter $D_4$ (FIG. 8). Simultaneously the radius $R_1$ under the bolt head is rolled to radius $R_2$. The allowance for rolling the diameter of the shank 5 is from 0.01 to 0.04 mm and the radius $R_2$ is 0.1 – 0.2 mm smaller than the radius $R_1$.

Figure 9:
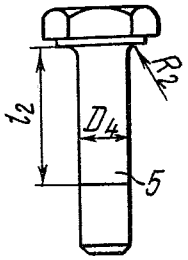
FIG. 9 shows the finished bolt after thread rolling.

The operation of thrad rolling shown in FIG. 9 is performed at a speed of 16 – 20 rpm within 0.5 – 1 s. Failure to conform with these conditions of rolling leads to peeling, exfoliation, cracking of threads and chipping of the material.

The finished bolts are subjected to a fluorescent penetrant inspection and a strength test. Thus, the finished bolts have the following mechanical properties: tensile strength $\delta_f \geqslant 100$ kgf/mm², shearing strength $\tau_{cp} \geqslant 63$ kgf/mm², elongation $\delta \geqslant 16\%$, and endurance under repeated static loads amounting to 0.4 rated value — not under 20000 cycles.

Given below are concrete examples of realizations of the present invention.

EXAMPLE 1

Fabrication of a countersunk head rivet with a shank of 5 mm diameter. The billet is a ground bar or wire having a diameter of 5.5 mm made of a high-strength two-phase titanium alloy of the following chemical composition: Al = 3.5%, Mo = 5.0%, V = 4.57, and the balance being Titanium with an ultimate strength of 85 kgf/mm². This bar is covered by a known method with an oxalate coating which forms a fine-crystalline salt film on the billet.

Then the process of cold plastic shaping is carried out as follows. A billet 15 mm long is cut off from the bar of 5.5 mm diameter. The billet is reduced at a speed of 1 m/s to a diameter of 5.02 mm on a length of 12.5 mm thus forming the shank. Now the remaining part of the billet is upset to form a barrel-shaped head having a diameter of 6.5 mm and being 1.8 mm high. Then the countersunk head is finally shaped at a speed of 1 m/s; the head is 9.0 mm in diameter and 2.5 mm high with the radius under the rivet head being equal to 0.7 mm.

After shaping the head and shank, the rivet is finished in a barrel, washed in hot water at 75° C and dried in a centrifuge.

Now the rivet shank and the radius under the head are rolled to size, namely to a diameter of 5.0 mm and a radius of 0.6 mm. The finished rivets are subjected to fluorescent penetrant inspection and a shear test. The shearing strength of the rivet is $\tau_{cp} \geqslant 63$ kgf/mm².

EXAMPLE 2

Fabrication of a hexagon-head bolt with a shank of 6 mm diameter. The billets are cut from a ground bar or wire having a diameter of 6.5 mm made of a high-strength two-phase titanium alloy with the following chemical composition: Al = 3.2%, Mo = 5.2%, V = 4.5%, and the balance being titanium with an ultimate strength of 90 kgf/mm². Then the bar is covered by a known method with an oxalate coating capable of forming a fine-crystalline salt film on the billet.

Then the process of cold plastic shaping is carried out as follows. A billet 30 mm long and 6.5 mm in diameter is sheared from the bar and reduced at a speed of 0.5m/s to a diameter of 6.03 mm on a length of 23.5 mm. Now the bolt head is shaped at a speed of 0.5 m/s to a diameter of 12 mm, a height of 2.5 mm and a radius under the head of 0.7 mm. The shank is reduced to a diameter of 5.31 mm on a length of 10 mm for threading.

The shank diameter is increased from 6.03 mm to 6.055 mm by the material filling the die channel.

Then the head is trimmed at a speed of 0.5 m/s to form a hexagon.

The bolt blank produced in this manner is barrel-finished, washed and dried in the manner described in Example 1.

The next step is to simultaneously roll the bolt shank on a length of 13.5 mm from a diameter of 6.055 mm to 6.02 mm and the radius under the bolt head from 0.7 mm to 0.6 mm.

Next, the M6 thread is rolled at a speed of 20 rpm within 1 s.

The lubricating and cooling fluids used in the course of shank rolling and thread rolling are constituted by widely known fluids, e.g. oils.

The finished parts are subjected to a fluorescent penetrant inspection and a strength test.

The mechanical properties of the finished bolts are as follows: tensile strength $\delta_f \geqslant 100$ kgf/mm², shearing strength $\tau_{cp} \geqslant 63$ kgf/mm², elongation $\delta \geqslant 16\%$, and durability under repeated static loads equal to 0.4 rated loads — not under 20000 cycles.

The use of other diameters, other shaping speeds, other thread rolling conditions and other allowances for rolling the shank and the radius under the head, not going beyond the above-mentioned limits, does not affect the mechanical properties of the finished headed-shank parts fabricated from high-strength two-phase titanium alloys.

What we claim is:

1. A method of fabricating headed-shank parts from billets made of high-strength two-phase titanium alloys, consisting of the steps of: applying a protective coating to said billet; forming a shank on a portion of said billet by cold reduction; heading the remaining portion of the billet with subsequent simultaneous rolling of the shank and of a radius under the head; and performing said shank forming and heading operations at a speed of 0.5–1.0 m/s.

2. The method according to claim 1, further consisting of the step of rolling a thread on the shank at a speed of about 16–20 rpm within about 0.5–1 s.

3. The method according to claim 1, wherein the diameter of the billet is equal to about 1.05–1.18 of the shank diameter.

4. The method according to claim 1, wherein the allowance for rolling the diameter of the shank is from about 0.01 to 0.04 mm.

5. The method according to claim 1, wherein the radius under the head is about 0.1–0.2 mm smaller after the rolling operation.

6. The method according to claim 1, further consisting of the step of having said protective coating form a fine crystalline salt film on said billet.

7. The method according to claim 6, wherein said protective coating is an oxalate coating.

* * * * *